US011692153B2

(12) United States Patent
Neubauer et al.

(10) Patent No.: US 11,692,153 B2
(45) **Date of Patent: *Jul. 4, 2023**

(54) LONG-CHAIN ALKYL ESTERQUATS FOR HIGHLY VISCOUS LAUNDRY AND CLEANING FORMULATIONS

(71) Applicant: EVONIK OPERATIONS GMBH, Essen (DE)

(72) Inventors: Stefan Neubauer, Cologne (DE); Jens Hildebrand, Johannesberg (DE); Dirk Kuppert, Frankfurt (DE)

(73) Assignee: Evonik Operations GmbH, Essen (DE)

( * ) Notice: Subject to any disclaimer, the term of this patent is extended or adjusted under 35 U.S.C. 154(b) by 185 days.

This patent is subject to a terminal disclaimer.

(21) Appl. No.: 17/257,661

(22) PCT Filed: Jul. 1, 2019

(86) PCT No.: PCT/EP2019/067540

§ 371 (c)(1),
(2) Date: Jan. 4, 2021

(87) PCT Pub. No.: WO2020/007775

PCT Pub. Date: Jan. 9, 2020

(65) Prior Publication Data

US 2021/0277329 A1 Sep. 9, 2021

(30) Foreign Application Priority Data

Jul. 5, 2018 (EP) ..... 18181831

(51) Int. Cl.

| | |
|---|---|
| ***C11D 1/62*** | (2006.01) |
| ***C11D 1/645*** | (2006.01) |
| ***C11D 3/00*** | (2006.01) |
| ***C11D 3/43*** | (2006.01) |
| ***C11D 11/00*** | (2006.01) |

(52) U.S. Cl.

CPC ..... *C11D 1/62* (2013.01); *C11D 1/645* (2013.01); *C11D 3/0015* (2013.01); *C11D 3/43* (2013.01); *C11D 11/0017* (2013.01); *C11D 11/0094* (2013.01)

(58) Field of Classification Search

CPC ..... C11D 11/0017; C11D 3/30; C11D 1/62; C11D 1/645

See application file for complete search history.

(56) References Cited

U.S. PATENT DOCUMENTS

| | | | | |
|---|---|---|---|---|
| 4,339,391 | A | 7/1982 | Hoffmann et al. | |
| 5,066,414 | A | 11/1991 | Chang | |
| 5,391,321 | A | 2/1995 | Gruning et al. | |
| 5,525,245 | A | 6/1996 | Grandmarie et al. | |
| 5,645,842 | A | 7/1997 | Gruning et al. | |
| 5,656,585 | A | 8/1997 | Grandmarie et al. | |
| 5,886,201 | A | 3/1999 | Bonastre et al. | |
| 6,432,895 | B1 | 8/2002 | Bigorra et al. | |
| 6,432,911 | B1 | 8/2002 | Buron et al. | |
| 6,720,300 | B1 * | 4/2004 | Endlein | C11D 17/0017 510/417 |
| 6,958,410 | B2 | 10/2005 | Koch et al. | |
| 7,727,599 | B2 | 6/2010 | Doehler et al. | |
| 7,834,122 | B2 | 11/2010 | Ferenz et al. | |
| 8,183,199 | B2 | 5/2012 | Fossum et al. | |
| 8,557,944 | B2 | 10/2013 | Henning et al. | |
| 8,569,224 | B2 | 10/2013 | Kohle et al. | |
| 8,653,214 | B2 | 2/2014 | Venzmer et al. | |
| 8,658,581 | B2 | 2/2014 | Hloucha et al. | |
| 8,796,198 | B2 | 8/2014 | Henning et al. | |
| 8,883,713 | B2 | 11/2014 | Parrish et al. | |
| 8,920,786 | B2 | 12/2014 | Hloucha et al. | |
| 9,090,853 | B2 | 7/2015 | Holderbaum et al. | |
| 9,138,385 | B2 | 9/2015 | Dahl et al. | |
| 9,320,697 | B2 | 4/2016 | Kleinen et al. | |
| 9,353,289 | B2 | 5/2016 | De Gans et al. | |
| 9,441,187 | B2 | 9/2016 | Köhle et al. | |
| 9,745,251 | B2 | 8/2017 | Klostermann et al. | |
| 11,312,926 | B2 | 4/2022 | Trambitas et al. | |
| 2002/0010104 | A1 | 1/2002 | Ewbank et al. | |
| 2003/0228991 | A1 * | 12/2003 | Johnson | C11D 3/2065 510/505 |
| 2004/0014627 | A1 | 1/2004 | Adams et al. | |

(Continued)

FOREIGN PATENT DOCUMENTS

| | | |
|---|---|---|
| DE | 197 51 151 | 5/1999 |
| DE | 19755488 | 6/1999 |

(Continued)

OTHER PUBLICATIONS

English translation for DE 102015223454 provided by Examiner in the Office Action for copending U.S. Appl. No. 16/644,685, dated Sep. 13, 2021.

English translation for WO 93/16157 provided by Examiner in the Office Action for copending U.S. Appl. No. 16/644,685, dated Sep. 13, 2021.

International Preliminary Report on Patentability for corresponding international application PCT/EP2019/067540 filed Jul. 1, 2019.

Cassel, et al., "Original Synthesis of Linear, Branched and Cyclic Oligoglycerol Standards," *Eur. J. Org. Chem.* 2001(5):815-896 (Mar. 2001).

DGF C-V 17a (53) Ph. Eur. 2.5.3 Method A, pp. 1-4 (downloaded Mar. 17, 2020).

Gooijer, et al., "Water and Energy Consumption in Domestic Laundering Worldwide—A Review," *Tenside Surf. Det.* 53(5):402-409 (2016).

(Continued)

*Primary Examiner* — Charles I Boyer

(74) *Attorney, Agent, or Firm* — Law Office of Michael A. Sanzo, LLC

(57) ABSTRACT

The invention relates to specific active compositions for producing highly viscous laundry and cleaning formulations, particularly laundry fabric softeners, to a method for the production thereof and to said laundry and cleaning formulations. High viscosity can be achieved in the products according to the invention despite a low concentration of active compositions and without using additional thickeners.

19 Claims, No Drawings

(56) References Cited

U.S. PATENT DOCUMENTS

| | | | |
|---|---|---|---|
| 2004/0142838 | A1 | 7/2004 | Azuma et al. |
| 2004/0142841 | A1 | 7/2004 | De Buzzaccarini et al. |
| 2004/0163182 | A1 | 8/2004 | Nguyen |
| 2006/0080786 | A1 | 4/2006 | Evers et al. |
| 2006/0200914 | A1 | 9/2006 | Evers et al. |
| 2006/0264352 | A1 | 11/2006 | Sajic et al. |
| 2007/0160652 | A1 | 7/2007 | Mueller et al. |
| 2007/0197678 | A1 | 8/2007 | Cavaleiro et al. |
| 2008/0004357 | A1 | 1/2008 | Meyer et al. |
| 2008/0305056 | A1 | 12/2008 | Jenni et al. |
| 2009/0124533 | A1 | 5/2009 | Kottke et al. |
| 2010/0104611 | A1 | 4/2010 | Chan et al. |
| 2010/0184634 | A1 | 7/2010 | Henault et al. |
| 2011/0239377 | A1 | 10/2011 | Fossum et al. |
| 2013/0012423 | A1 | 1/2013 | Hloucha et al. |
| 2013/0102520 | A1 | 4/2013 | Holderbaum et al. |
| 2013/0217930 | A1 | 8/2013 | Haensel et al. |
| 2015/0073069 | A1 | 3/2015 | De Gans et al. |
| 2015/0297485 | A1 | 10/2015 | Kleinen et al. |
| 2017/0009184 | A1 | 1/2017 | Schubert et al. |
| 2018/0133133 | A1 | 5/2018 | Kleinen et al. |
| 2020/0155436 | A1 | 5/2020 | Hartung et al. |
| 2020/0283707 | A1 | 9/2020 | Dahl et al. |
| 2020/0299616 | A1 | 9/2020 | Trambitas et al. |

FOREIGN PATENT DOCUMENTS

| | | | |
|---|---|---|---|
| DE | 102015223454 | 6/2016 | |
| EP | 1 972 330 | 9/2008 | |
| EP | 2 301 987 | 3/2011 | |
| JP | H11508291 | 7/1999 | |
| JP | 2002-167437 | 6/2002 | |
| JP | 2002201494 | 7/2002 | |
| WO | WO 93/16157 | 8/1993 | |
| WO | WO-9743388 A2 * | 11/1997 | ..... C11D 1/62 |
| WO | WO 98/23808 | 6/1998 | |
| WO | WO 02/086044 | 10/2002 | |
| WO | WO 2008/040785 | 4/2008 | |
| WO | WO 2011/123284 | 10/2011 | |
| WO | WO 2011/123733 | 10/2011 | |
| WO | WO 2014/018578 | 1/2014 | |
| WO | WO 2014/143182 | 9/2014 | |
| WO | WO 2016/055341 | 4/2016 | |
| WO | WO 2018/001889 | 1/2018 | |
| WO | WO 2020/007670 | 1/2020 | |

OTHER PUBLICATIONS

Wang, et al., "Carbohydrate-Modified Siloxane Surfactants and Their Adsorption and Aggregation Behavior in Aqueous Solution," *J. Phys. Chem.* B 114(20):6872-6877 (May 2010).

U.S. Appl. No. 16/644,685, filed Mar. 5, 2020, US-2020/0283707 A1, Sep. 10, 2020, Dahl.

U.S. Appl. No. 16/650,344, filed Mar. 24, 2020, US-2020/0299616 A1, Sep. 24, 2020, Trambitas.

English language translation of the International Search Report for corresponding international application PCT/EP2019/067540 filed Jul. 1, 2019.

English language translation of the Written Opinion of the International Searching Authority for corresponding international application PCT/EP2019/067540 filed Jul. 1, 2019.

* cited by examiner

LONG-CHAIN ALKYL ESTERQUATS FOR HIGHLY VISCOUS LAUNDRY AND CLEANING FORMULATIONS

CROSS REFERENCE TO RELATED APPLICATIONS

The present application is US national stage of international application PCT/EP2019/067540, which had an international filing date of Jul. 1, 2019 and which was published on Jan. 9, 2020. The application claims priority under 35 USC § 119 to European application 18181831.1, filed in on Jul. 5, 2018. The contents of the priority application is hereby incorporated by reference in its entirety.

The invention relates to specific active compositions for producing highly viscous laundry and cleaning formulations, particularly laundry fabric softeners, to a method for the production thereof and to laundry and cleaning formulations comprising said active compositions. High viscosity can be achieved in the products according to the invention despite a low concentration of active compositions and without using additional thickeners.

1. PRIOR ART

In regional markets, Brazil for example, laundry and cleaning formulations, particularly fabric softeners, are required which have a high viscosity at low active contents, i.e. a low content of quaternary ammonium compounds.

Solely by the use of quaternary ammonium compounds, also referred to below as "quats" or "ester quats", such as Rewoquat WE 18 for example, the required viscosity could not be achieved to date. For instance, using triethanolamine-based ester quats, as described for example in WO 2014/143182 A2, DE 10 2010 030 217 A1 and DE 197 43 687 C1, in the case of sole use of the quat, viscosities of only at most 500 mPas are achieved.

DE2928603 discloses, inter alia, so-called "hybrid" quats. These are characterized in that, in addition to alkanol and alkanol ester radicals, they also comprise a long-chain alkyl radical. The hybrid quats of DE2928603 are intended to impart a pleasant softness to the laundry. Viscosities of the fabric softeners produced with these hybrid quats are not specified in DE 2928603. However, it is indicated that further substances and auxiliaries have to be added to the fabric softener composition to adjust, inter alia, the viscosity. Such addition of auxiliaries, especially thickeners, is customary in the prior art, but is associated with ecological and economic disadvantages.

WO 2016/055341 describes active compositions comprising bis(2-hydroxypropyl)dimethylammonium methylsulfate fatty acid ester, with which aqueous and storage-stable fabric softener formulations can be produced having high viscosity. A disadvantage of these active compositions is that relatively large amounts have to be used to enhance viscosity.

US 2006/0264352 A1 describes fabric softener formulations comprising ester quats having high viscosity. In order to achieve high viscosity, long-chain alkylamines have to be added as viscosity regulators.

There is therefore a need for novel active compositions and of laundry and cleaning formulations, especially fabric softeners, which do not have the disadvantages of the prior art or only to a lesser degree, which preferably can render the use of thickeners obsolete.

2. PROBLEM

It was therefore the object of the present invention to provide novel active compositions and novel laundry and cleaning formulations, especially fabric softener formulations, which do not have the disadvantages of the prior art or only to a lesser degree.

In one specific object, the laundry and cleaning formulations, solely by means of the active compositions according to the invention, without adding additional thickeners, should have a sufficiently high viscosity at the required low active content.

In a further object, it should be possible, solely by the use of the active compositions according to the invention, to be able to adjust the viscosity of laundry and cleaning formulations over a broad spectrum.

In a further preferred object, fabric softener products according to the invention should have at least a comparable fabric softening effect as products of the prior art.

A further object can be considered to be that of providing laundry and cleaning formulations, especially fabric softener products, which are biodegradable.

Other objects not explicitly mentioned will be apparent from the entirety of the present description, claims and examples.

3. DEFINITIONS OF TERMS

Before the invention is described in detail, a number of terms will first be defined:

In the context of the present invention, "active compositions" are understood to mean compositions comprising mixtures of ester quats of the general formula I defined in more detail below. The activity of these ester quats is characterized, inter alia, by their thickening effect, but on the other hand also by their fabric softening effect. The active compositions may consist exclusively of ester quats of the general formula I, but they can also be diluted with a solvent, for example for better handling.

"Laundry and cleaning formulations" are understood to mean all types of laundry and cleaning formulations in which ester quats are customarily used. These preferably take the form of fabric softener formulations. The laundry and cleaning formulations according to the invention may comprise but also consist only of the active compositions according to the invention. Typically, they comprise at least a perfume oil and water in addition to the active compositions according to the invention.

In the context of the present invention, "high viscosity" is understood to mean a viscosity of more than 500 mPas, preferably more than 750 mPas, particularly preferably more than 1000 mPas.

In the context of the present invention, a laundry and cleaning formulation with "low active content" is understood to mean a laundry and cleaning formulation comprising in total a content of active compositions according to the invention of less than 5% by weight, more preferably less than 3% by weight, based on the total composition of the laundry and cleaning formulations.

4. DETAILED DESCRIPTION OF THE INVENTION

Surprisingly, it has been found that active compositions according to claim 1 and laundry and cleaning formulations, especially fabric softener formulations, comprising these active compositions according to claim 7, solve the stated objects. The active compositions according to the invention comprise mixtures of specific ester quats of the general formula I defined further in more detail below. By means of their use, fabric softener formulations could be obtained which have a high viscosity despite having a low active content. The viscosities were at least 10% above the maximum achieved 500 mPas of the prior art and reached up to 2400 mPas. Therefore, solely by the use of the active compositions according to the invention, it has been possible to adjust the viscosity of the fabric softener formulation over a very broad spectrum at a low active ingredient content.

The ester quats used according to the invention enable the production of ecologically favourable laundry and cleaning formulations.

In addition, the laundry and cleaning formulations according to the invention can be produced with high viscosity at a low content of active compositions without adding thickeners. This increases the ecological, but also economic advantages. The fact that the laundry and cleaning formulations according to the invention can be produced without adding thickeners does not in principle exclude their use.

The present invention accordingly provides active compositions according to claim 1 and a method for the preparation thereof according to claim 6. Further provided are laundry and cleaning formulations, preferably fabric softener formulations, comprising the inventive active compositions according to claim 7 and the use of the inventive active compositions according to claim 8. Preferred embodiments are claimed in the dependent claims.

The present invention provides in particular active compositions for producing laundry and cleaning formulations, preferably fabric softener formulations, which are characterized in that they comprise a mixture of two or more quaternary ammonium salts of the general formula I)

general formula I)

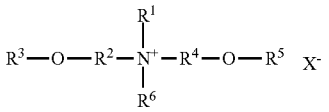

where $R^1$ is a linear or branched hydrocarbon radical having an iodine number of less than or equal to 10, preferably less than or equal to 8, particularly preferably from 0 to 5, comprising 10 to 32 carbon atoms, preferably 12 to 22 carbon atoms, particularly preferably 14 to 20 carbon atoms and especially 16 to 18 carbon atoms, $R^2$, $R^4$ are the same or different, each independently selected from the group comprising divalent, preferably linear, hydrocarbon radicals comprising 1 to 4 carbon atoms, preferably methylene, ethylene and n-propylene, particularly preferably ethylene, $R^3$ is hydrogen or acyl radical of a fatty acid having a chain length of 8 to 32 carbon atoms, preferably 12 to 22 carbon atoms, especially 14 to 18 carbon atoms, $R^5$ is the same as or different from $R^3$, hydrogen or acyl radical of a fatty acid having a chain length of 8 to 32 carbon atoms, preferably 12 to 22 carbon atoms, especially 14 to 18 carbon atoms, $R^6$ is a hydrocarbon radical comprising 1 to 4 carbon atoms, preferably methyl or ethyl, particularly preferably methyl, $X^-$ is methylsulfate or ethylsulfate, wherein the amount ratio of the quaternary ammonium salts of the general formula I) in the mixture is a result of one or more amine(s) of the general formula II)

general formula II)

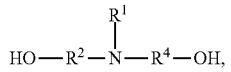

where $R^1$, $R^2$ and $R^4$ have the same definition as in formula I), being reacted with one or more fatty acids corresponding to $R^3$ and $R^5$, in the molar ratio of the sum of all amines of the general formula II) to the sum of all fatty acids of from 0.8 to 1.5, preferably 0.8 to 1.4, particularly preferably 0.85 to 1.3, and especially preferably 0.9 to 1.2.

As shown in comparative example V7, a too low molar ratio results in non-inventive active compositions having a distinctly lower thickening capacity. A molar ratio, which is too high, results in the same effect, i.e. in a decrease of the thickening capacity.

The selection of the alkylating agent for the quaternization, especially of $X^-$, also has a crucial influence on the thickening capacity of the quats. As shown in comparative examples V1 and V2, thickening by quats where $X^-=Cl^-$ is considerably worse than those where $X^-=MeSO_4^-$.

Finally, the inventors found out that, surprisingly, the alkyl radical $R^1$ should have a high mobility, i.e. a low number of double bonds, preferably no double bonds. This is shown in the examples in the comparison of $R^1$=tallow (see comparative examples V3 to V6) with $R^1$=hydrogenated tallow. The proportion of double bonds in $R^1$ is expressed by the iodine number. The radicals $R^1$ used in accordance with the invention have an iodine number of less than or equal to 10, preferably less than or equal to 8, particularly preferably from 0 to 5.

$R^1$ is preferably a hydrocarbon radical which is the hydrocarbon radical of fatty alcohols. In the context of the present invention, a "hydrocarbon radical of a fatty alcohol" is the structure remaining after deletion of the OH group of the fatty alcohol. A preferred radical $R^1$ is a hydrocarbon radical of an unbranched or branched monoalcohol having an alkyl group of 10 to 22 carbon atoms. Preferred radicals $R^1$ are hydrocarbon radicals of cetyl alcohol, palmoleyl alcohol, stearyl alcohol, isostearyl alcohol, anteisostearyl alcohol, eicosanol, petroselinyl alcohol, Guerbet alcohol, arachyl alcohol, gadoleyl alcohol, and mixtures thereof, especially of technical-grade mixtures, preferably of technical-grade stearyl, palmityl or hydrogenated tallow fatty alcohols having 12 to 22, preferably having 14 to 20 carbon atoms, and also of the monounsaturated fatty alcohols such as oleyl alcohol, elaidyl alcohol, delta-9-cis-hexadecenol, delta-9-octadecenol, trans-delta-9-octadecenol, cis-delta-11-octadecenol, trans-10,cis-12-hexadecadien-1-ol, octacosa-10,19-dien-1-ol, wherein particular preference is given to hydrocarbon radicals of mixtures of stearyl or hydrogenated tallow fatty alcohols having 14 to 22, particularly preferably 14 to 18 and especially preferably 16 to 18 carbon atoms.

If mixtures of hydrocarbons of fatty alcohols are used as $R^1$, especially technical-grade mixtures, the iodine number is the average iodine number of the mixture. The same applies to the fatty acids described further below, i.e. the radicals $R^3$ and $R^5$.

Since the quats of the general formula I are obtained by reacting one or more amine(s) of the general formula II) defined above with one or more fatty acids corresponding to $R^3$ and $R^5$, in the molar ratio defined above, the result is that a proportion of the OH groups of the amine as such remain intact. This is important in order to ensure the correct polarity of the quats. Furthermore, it follows from this that a mixture of different quats of the general formula I is obtained in the reaction in which either both OH groups or only one OH group or neither OH group is esterified. Therefore, $R^3$ and $R^5$ can either both be acyl or both H or one of the two is acyl and one is H. If the radicals $R^3$ and $R^5$ are both acyl radicals, they are preferably acyl esters of the same fatty acid or fatty acid mixture.

Preferred fatty acids for $R^3$ and $R^5$ are selected from plant or tallow fatty acids, preferably having an iodine number from 0 to 50, particularly preferably 5 to 45, and especially preferably 10 to 25, plant or tallow fatty acids having an iodine number of less than or equal to 10, preferably less than or equal to 8, particularly preferably from 0 to 5, the fatty acids corresponding to the alkyl radicals $R^1$ defined as preferred in more detail above $R^2$ and $R^4$ are preferably identical and preferably both are $C_2H_4$ or both are $C_3H_6$; particularly preferably both are $C_2H_4$.

Particularly preferred active compositions according to the invention are mixtures of quaternary ammonium compounds of the general formula I), wherein the radicals $R^1$ to $R^6$ and $X^-$ are selected from the following groups:

$R^1$ is a linear alkyl radical comprising 14 to 20, preferably 16 to 18 carbon atoms having an iodine number less than 8, preferably less than or equal to 5, $R^2$, $R^4$ are $C_2H_4$, $R^3$, $R^5$ are the same or different, each independently hydrogen or an acyl radical of a fatty acid having a chain length of 12 to 22 carbon atoms, preferably 16 to 18 carbon atoms, $R^6$ is methyl or ethyl, preferably methyl, $X^-$ is methylsulfate or ethylsulfate, preferably methylsulfate The active compositions according to the invention result in that the laundry and cleaning formulations, preferably fabric softener formulations produced therewith, already have high viscosities at low contents of these active compositions and without additional thickeners. The laundry and cleaning formulations, preferably fabric softener formulations according to the invention, therefore include the active compositions according to the invention preferably in an amount from 1% by weight to 6% by weight, particularly preferably from 2% by weight to 5% by weight, where the percentages by weight refer to the total composition.

In addition, the laundry and cleaning formulations, preferably fabric softener formulations, may also comprise water and further additives and/or auxiliaries, e.g. selected from the group comprising emollients, pearlescent additives, dyes, insect repellents, preservatives, perfumes, dyes and defoamers, in the laundry and cleaning formulations. The amounts of the particular additives are determined by the intended use.

Typical guide formulations for the respective applications are known prior art and are contained for example in the brochures of the manufacturers of the particular basic materials and active ingredients. These existing formulations can generally be adopted unchanged. If necessary, the desired modifications can, however, be undertaken without complication by means of simple experiments for the purposes of adaptation and optimization.

The active compositions according to the invention are preferably prepared by a method comprising the following steps of:

a) reacting one or more amine(s) of the general formula II), general formula II)

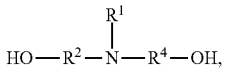

where $R^1$, $R^2$ and $R^4$ have the same definition as above, with one or more fatty acid(s) having a chain length of 8 to 32 carbon atoms, preferably 12 to 22 carbon atoms, particularly preferably 16 to 18 carbon atoms, in the molar ratio of the sum of all amines of the general formula II) to the sum of all fatty acids of from 0.8 to 1.6, preferably 0.8 to 1.5, particularly preferably 0.8 to 1.5, very particularly preferably 0.8 to 1.4, especially preferably 0.85 to 1.3, and very especially preferably 0.9 to 1.2, are reacted, b) reacting the amines of step a) with an alkylating agent, selected from the group consisting of dimethyl sulfate and diethyl sulfate, for preparing quaternary ammonium salts of the formula I).

Preferably, the active composition mixture obtained according to step b), for better handleability, is diluted in step c) with 30-40% by weight, preferably 10-20% by weight, of a water-miscible solvent. Such solvents are, for example, ethanol, 1-propanol, 2-propanol, 1,2-ethylene glycol, 1,2-propylene glycol, 1,3-propylene glycol, dipropylene glycol, ethylene glycol ether or propylene glycol ether or mixtures thereof.

The active compositions according to the invention particularly preferably consist only of the mixture obtained according to step b) or the diluted mixture obtained according to step c).

Technologies for carrying out steps a) and b) are known per se to those skilled in the art.

The active compositions according to the invention obtained according to step b) or c) are further processed to produce the laundry and cleaning formulations, preferably fabric softener formulations according to the invention, preferably as follows:

Water is initially charged in a stirred vessel and heated to a temperature between 20 and 60° C. The active compositions are melted and brought to a temperature between 30 and 60° C. The melt is introduced into the water charge with vigorous stirring. The dispersion thus obtained is cooled and optionally further additives described in detail below are added.

As already mentioned, the active compositions according to the invention are used as active ingredients in laundry and cleaning formulations. They can in principle be used in any laundry and cleaning formulation in which quats are used in customary fashion. They are particularly preferably used in laundry and cleaning formulations which should have a high viscosity and especially preferably in those which should have a high viscosity at a low active content.

Most preferably, the laundry and cleaning formulations are fabric softeners. Preferred fabric softener formulations according to the invention for the household and industrial and institutional applications, comprising at least one of the active compositions according to the invention, are laundry detergents, laundry care products, disinfecting laundry detergents, heavy-duty laundry detergents, light-duty laundry detergents, wool laundry detergents, fabric softeners and impregnating agents, particular preference being given to laundry detergents, laundry care products, heavy-duty laundry detergents, light-duty laundry detergents, wool laundry detergents, fabric softeners, impregnating agents, especially fabric softeners.

A fabric softener formulation according to the invention preferably comprises the active compositions according to the invention in an amount of 1% by weight to 5% by weight, preferably of 2% by weight to 4% by weight, where the percentages by weight are based on the overall formulation. The remaining mass to 100% by weight preferably consists of water and/or at least one additive and/or auxiliary selected from the group of the emollients, viscosity regulators, pearlescent additives, dyes, insect repellents, preservatives, perfumes, dyes and defoamers.

The perfume used may be any of the fragrances or fragrance mixtures known to be suitable for fabric softeners from the prior art, preferably in the form of a perfume oil. Examples of fragrances or scents are disclosed inter alia in DE 197 51 151 A1, page 4, lines 11-17. More particularly, the compositions according to the invention may contain from 0.01% to 10% by weight, more preferably 0.1% to 5% by weight, based on the overall composition of the composition, of one or more perfumes.

Dyes used may be any dyes known to be suitable for fabric softeners from the prior art, preference being given to water-soluble dyes. Examples of suitable water-soluble commercial dyes are SANDOLAN® Walkblau NBL 150 (manufacturer: Clariant) and Sicovit® Azorubin 85 E122 (manufacturer: BASF). More particularly, the compositions according to the invention may contain from 0.001% to 0.1% by weight, more preferably from 0.002% to 0.05% by weight, of one or more dyes.

As already mentioned previously, no viscosity regulators are required in the laundry and cleaning formulations, especially fabric softener formulations according to the invention, since the viscosity can be adjusted solely with the aid of the active compositions according to the invention. However, the addition of other viscosity regulators is nevertheless not excluded. For instance, the viscosity regulator for reducing viscosity may be an alkali metal or alkaline earth metal salt, or mixtures thereof, preferably calcium chloride, preferably in an amount of 0.05% to 2% by weight, based on the overall composition of the composition.

As viscosity regulator for increasing the viscosity, the fabric softener may comprise a thickener known from the prior art, preference being given to the polyurethane thickeners known from WO 2007/125005. Examples of suitable thickeners are TEGO® Visco Plus 3030 (manufacturer: Evonik Tego Chemie), Acusol® 880 and 882 (manufacturer: Rohm & Haas), Rheovis® CDE (manufacturer: BASF), Rohagit® KF 720 F (manufacturer: Evonik Röhm GmbH) and Polygel® K100 from Neochem GmbH.

Defoamers used may be any defoamers known to be suitable for fabric softeners from the prior art. Examples of suitable commercial defoamers are Dow Corning® DB-110A and TEGO® Antifoam® 7001 XP. More particularly, the compositions according to the invention may contain from 0.0001% to 0.05% by weight, preferably from 0.001% to 0.01% by weight, of one or more different defoamers.

As preservative, the fabric softener may comprise active bactericidal and/or fungicidal ingredients known to be suitable from the prior art, preference being given to water-soluble active ingredients. Examples of suitable commercial bactericides are methylparaben, 2-bromo-2-nitropropane-1, 3-diol, 2-methyl-4-isothiazolin-3-one and 5-chloro-2-methyl-4-isothiazolin-3-one. The aqueous fabric softener may likewise comprise an oxidation inhibitor as preservative. Examples of suitable commercial oxidation inhibitors are ascorbic acid, 2,6-di-tert-butyl-4-methylphenol (BHT), butylhydroxyanisole (BHA), tocopherol and propyl gallate. More particularly, the compositions according to the invention may contain from 0.0001% to 0.5%, more preferably 0.001% to 0.2% by weight, of one or more different preservatives. More particularly, the compositions according to the invention may contain from 0.001% to 0.1% by weight, preferably 0.001% to 0.01% by weight, of one or more different oxidation inhibitors.

The amounts of the particular additives are determined by the intended use.

Typical guide formulations for the respective applications are known prior art and are contained for example in the brochures of the manufacturers of the particular basic materials and active ingredients. These existing formulations can generally be adopted unchanged. If necessary, the desired modifications can, however, be undertaken without complication by means of simple experiments for the purposes of adaptation and optimization.

5. METHODS OF MEASUREMENT

5.1 Determination of the Iodine Number

The iodine number specifies how many grams of halogen, calculated as iodine, of 100 g of an examined sample are bonded under the conditions of a method. In accordance with the invention, the measuring method by Wijs is applied in accordance with DIN 53241-1:1995-05.

Whereas the iodine number of the radical $R^1$ on the amine of the general formula (II) can be measured directly, the iodine number of the quaternary ammonium compound of the general formula (I) is measured by firstly saponification of the acyl radicals using alkali and separation of the fatty acids and ammonium compounds thus obtained by known methods. The iodine number of $R^1$, from the ammonium compound, and that of the fatty acids can then be determined according to the method of Wijs.

5.2 Determination of the Viscosity of the Laundry and Cleaning Formulations

The measurement of the viscosity is carried out using a Brookfield LVT viscometer and a spindle suitable for the viscosity range at a temperature of 25° C. and 30 rpm.

6. EXAMPLES

The examples adduced hereinafter describe the present invention by way of example, without any intention that the invention, the scope of application of which is apparent from the entirety of the description and the claims, should be restricted to the embodiments specified in the examples.

6.1 Starting Materials Used:

6.1.1 Amines of the General Formula II:

TABLE 1

| Amine | $R^1$ (all % figures are mol %) | $R^2$ | $R^3$ | Trade name | Source |
|---|---|---|---|---|---|
| A1 | Stearyl having 93% C18, 5% C16, 2% > C20 with IN = 0-3.0 | $C_2H_4$ | $C_2H_4$ | Varonic S 202 | Evonik Corporation, USA |
| A2 | Tallow having 3% C14, 30% C16, 67% C18 with IN = 38.0-54.0 | $C_2H_4$ | $C_2H_4$ | Varonic T 202 | Evonik Corporation, USA |
| A3 | Hydr. tallow having 3% C14, 30% C16, 67% C18 with IN <= 3.0 | $C_2H_4$ | $C_2H_4$ | Varonic U 202 | Evonik Corporation, USA |

6.1.2 Fatty Acids:

TABLE 2

| Fatty acids | Source | IN |
|---|---|---|
| FA1 | Tallow fatty acid, Edenor T20, KLK Oleo | 18-22 |
| FA2 | Tallow fatty acid, Raciacid 0474, Oleon | 30-42 |
| FA3 | Hydrogenated tallow fatty acid, Baerocid SMS-1A, Baerlocher | <1.0 |
| FA4 | Stearic fatty acid, plant-based, Pristeren 4928, Croda | <2.0 |

6.1.3 Alkylating Agents

TABLE 3

| Designation | Source |
|---|---|
| MeCl | Methyl chloride |
| DMS | Dimethyl sulfate, Aldrich |
| DES | Diethyl sulfate, Aldrich |

6.2 General Preparation Method of the Quaternary Ammonium Compounds:

Example E1

571 g (1.588 mol) of amine A1 were placed in a three-necked flask equipped with column, distillation system and stirrer motor and heated to 80° C. under a nitrogen atmosphere. To this were added 352.2 g (1.271 mol) of fatty acid FA 3 and 0.46 g of 50% aqueous hypophosphorous acid. A vacuum of 100 mbar was applied and the mixture was cautiously heated to 195° C., wherein water of reaction was collected in the outflow of the distillation system. After 2.5 hours, the vacuum was lowered to 20 mbar and further reacted for 1.5 hours. The condensation product thus obtained had an acid number of 0.9 mg KOH/g and an amine number of 96.2 mg KOH/g. The reaction mixture was cooled to 80° C. Over one hour, 186.2 g (1.477 mol) of dimethyl sulfate were added dropwise with stirring, wherein the temperature was maintained in a range of 80-95° C. Subsequently, 120 g of anhydrous ethanol were added and the mixture was further stirred at 80° C. for one hour. The quat mixture thus obtained had an amine number of 3.1 mg KOH/g.

The further examples and comparative examples were carried out according to this procedure but with varied reactants or varied amount ratios—in each case as stated in tables 4 and 5 below.

6.3 Application Tests

Table 4 specifies various inventive laundry and cleaning formulations by way of example. In each case, according to the procedure of 6.2, quat mixtures were prepared corresponding to the data in table 4, and were mixed with water such that each formulation resulted in 3% by weight quat mixture (calculated based on the solids content), 0.2% perfume oil, and water to 100%. The viscosity of the formulation obtained was determined in each case.

TABLE 4

| Example | Amine | Fatty acid | Iodine number | Moles of fatty acid per mole of amine | Alkylating agent | Viscosity @ 3% in mPas |
|---|---|---|---|---|---|---|
| E1 | A1 | FA3 | <1.0 | 0.8 | DMS | 2400 |
| E2 | A1 | FA3 | <1.0 | 1.0 | DMS | 1000 |
| E3 | A1 | FA3 | <1.0 | 1.2 | DMS | 1060 |

TABLE 4-continued

| Example | Amine | Fatty acid | Iodine number | Moles of fatty acid per mole of amine | Alkylating agent | Viscosity @ 3% in mPas |
|---|---|---|---|---|---|---|
| E4 | A1 | FA1 | 18-22 | 0.8 | DES | 600 |
| E5 | A1 | FA1 | 18-22 | 0.8 | DMS | 860 |
| E6 | A1 | FA1 | 18-22 | 1.0 | DMS | 1080 |
| E7 | A1 | FA1 | 18-22 | 1.2 | DMS | 580 |
| E8 | A1 | FA2 | 30-42 | 1.0 | DMS | 590 |
| E9 | A3 | FA1 | 18-22 | 1.0 | DMS | 770 |
| E10 | A3 | FA3 | <1.0 | 1.2 | DMS | 580 |
| E11 | A3 | FA1 | 18-22 | 0.8 | DMS | 560 |
| E12 | A1 | FA4 | <2.0 | 0.8 | DMS | 1700 |

For comparison, non-inventive examples are shown in table 5 in which:

in V1 and V2, MeCl was used instead of DMS as alkylating agent in V3 to V6, the amine A2 substituted by $R^1$ equals tallow having an iodine number of 18-22 was used instead of amine A3 substituted by $R^1$ equals hydrogenated tallow having an iodine number of <1.0 in V7, an amine with a molar ratio of less than 0.8 was used.

TABLE 5

| Example | Amine | Fatty acid | IN | Molar ratio moles of fatty acid per mole of amine | Alkylating agent | Viscosity @ 3% in mPas |
|---|---|---|---|---|---|---|
| V1 | A1 | FA3 | <1.0 | 1.0 | MeCl | 130 |
| V2 | A1 | FA1 | 18-22 | 1.0 | MeCl | 350 |
| V3 | A2 | FA1 | 18-22 | 1.2 | DMS | 100 |
| V4 | A2 | FA1 | 18-22 | 1.0 | DMS | 40 |
| V5 | A2 | FA1 | 18-22 | 0.8 | DMS | 30 |
| V6 | A2 | FA3 | <1.0 | 1.0 | DMS | 315 |
| V7 | A1 | FA3 | <1.0 | 0.6 | DMS | 155 |

The comparisons of V1 with E2 and of V2 with E6 show that the use of DMS instead of MeCl as alkylating agent contributes significantly to the solution to the problem of the present invention.

The comparisons of V3 with E7, V4 with E6, V5 with E7 and V6 with E2 show that the use of radicals $R^1$ with an iodine number of less than 10 instead of a radical $R^1$ with a higher iodine number, at otherwise identical conditions, results in significantly higher viscosities.

The comparison of V7 with E1 to E3 shows the influence of the molar ratio of fatty acid to amine. If this is too low, as in V7, an insufficient thickening effect is achieved.

The invention claimed is:

1. An active composition for producing laundry and cleaning formulations, comprising a mixture of two or more quaternary ammonium salts of the general formula I):

I)

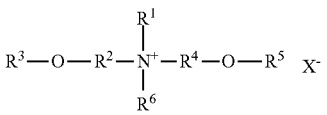

wherein:

$R^1$ is a linear or branched hydrocarbon radical having an iodine number of from 0 to 5, and comprising 14 to 20 carbon atoms;

$R^2$, $R^4$ are the same or different, each independently selected from divalent, linear hydrocarbon radicals comprising 1 to 4 carbon atoms;

$R^3$ is hydrogen or an acyl radical of a fatty acid comprising a chain length of 12 to 22 carbon atoms;

$R^5$ is the same as, or different from, $R^3$, and is an acyl radical of a fatty acid comprising a chain length of 12 to 22 carbon atoms;

$R^6$ is methyl or ethyl;

$X^-$ is methylsulfate or ethylsulfate;

wherein:

the amount ratio of the quaternary ammonium salts of the general formula I) in the mixture is a result of one or more amine(s) of the general formula II):

II)

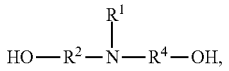

wherein:

$R^1$, $R^2$ and $R^4$ have the same definition as in formula I), being reacted with one or more fatty acids corresponding to $R^3$ and $R^5$, in the molar ratio of the sum of all amines of the general formula II) to the sum of all fatty acids of from 0.8 to 1.5.

2. The active composition of claim 1, wherein:

the amount ratio of the quaternary ammonium salts of the general formula I) in the mixture is a result of one or more amine(s) of the general formula II) where $R^1$, $R^2$ and $R^4$ have the same definition as in formula I), being reacted with one or more fatty acids corresponding to $R^3$ and $R^5$, in the molar ratio of the sum of all amines of the general formula II) to the sum of all fatty acids of from 0.9 to 1.2.

3. The active composition of claim 1, wherein the active composition is for producing a fabric softener formulation, wherein:

$R^1$ is a linear or branched hydrocarbon radical having an iodine number of from 0 to 5, and comprising 16 to 18 carbon atoms;

$R^2$, $R^4$ are ethylene;

$R^3$ is hydrogen or an acyl radical of a fatty acid having a chain length of 16 to 18 carbon atoms;

$R^5$ is the same as or different from $R^3$, and is an acyl radical of a fatty acid having a chain length of 16 to 18 carbon atoms;

$R^6$ is methyl.

4. The active composition of claim 1, wherein one or both $R^2$ and $R^4$ radicals are ethylene.

5. The active composition of claim 1, wherein $R^3$ and $R^5$ are radicals of the same fatty acid or fatty acid mixture.

6. The active composition of claim 1, wherein the mixture comprises quaternary ammonium compounds of the general formula I), wherein:

$R^3$, $R^5$ are the same or different, each independently being an acyl radical of a fatty acid having a chain length of 16 to 18 carbon atoms;

$R^6$ is methyl.

7. The active composition of claim 1, wherein:

$R^3$ and $R^5$ are acyl radicals selected from:

plant or tallow fatty acids, having an iodine number from 0 to 50;

plant or tallow fatty acids having an iodine number of less than or equal to 10.

8. The active composition of claim 1, wherein:

$R^3$ and $R^5$ are acyl radicals selected from:

plant or tallow fatty acids, having an iodine number from 10 to 25;

plant or tallow fatty acids having an iodine number of from 0 to 5.

9. A method for preparing the active composition of claim 1, comprising:

a) reacting one or more amine(s) of the general formula II),

II)

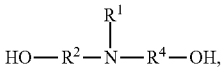

wherein $R^1$, $R^2$ and $R^4$ have the same definition as in claim 1, with one or more fatty acid(s) having a chain length of 12 to 22 carbon atoms, and the molar ratio of the sum of all amines of the general formula II) to the sum of all fatty acids of from 0.8 to 1.5;

b) reacting the amines of step a) with an alkylating agent, selected from the group consisting of: dimethyl sulfate and diethyl sulfate, for preparing quaternary ammonium salts of the formula I).

10. The method of claim 9, further comprising:

c) diluting the active composition mixture obtained according to step b) with 30-40% by weight, of a water-miscible solvent.

11. The method of claim 9, and further comprising:

c) diluting the active composition mixture obtained according to step b) with 10-20% by weight, of a water-miscible solvent.

12. The method of claim 9, and further comprising:

c) diluting the active composition mixture obtained according to step b) with one or more solvents selected from the group consisting of: ethanol; 1-propanol; 2-propanol; 1,2-ethylene glycol; 1,2-propylene glycol; 1,3-propylene glycol; dipropylene glycol; dipropylene glycol; ethylene glycol ether; and propylene glycol ether.

13. The method of claim 9, wherein $R^1$, $R^2$ and $R^4$ have the same definition as in claim 1, with one or more fatty acid(s) having a chain length of 16 to 18 carbon atoms, and wherein the molar ratio of the sum of all amines of the general formula II to the sum of all fatty acids of from 0.9 to 1.2.

14. A laundry and cleaning formulation, comprising an active composition according to claim 1.

15. The laundry and cleaning formulation of claim 14, wherein the formulation is a fabric softener formulation.

16. The laundry and cleaning formulation of claim 14, comprising the active composition in from 1% by weight to 6% by weight, where the percentages by weight refer to the total composition.

17. The laundry and cleaning formulation of claim 14, comprising the active composition in from 2% by weight to 5% by weight, where the percentages by weight refer to the total composition.

18. The laundry and cleaning formulation of claim 14, comprising a viscosity of more than 500 mPas, measured using a Brookfield LVT viscometer and a spindle suitable for the viscosity range at a temperature of 25° C. and 30 rev/min.

19. The laundry and cleaning formulation of claim 14, comprising a viscosity of more than 1000 mPas, measured using a Brookfield LVT viscometer and a spindle suitable for the viscosity range at a temperature of 25° C. and 30 rev/min.

* * * * *